US005911371A

United States Patent [19]

Strasser

[11] Patent Number: 5,911,371

[45] Date of Patent: Jun. 15, 1999

[54] TWO-ROLL PRESS FOR PRESSURE TREATMENT OF GRANULAR MATERIAL

[75] Inventor: Siegfried Strasser, Much, Germany

[73] Assignee: Deutz Aktiengesellschaft, Patente und Marken, Koeln, Germany

[21] Appl. No.: 08/938,022

[22] Filed: Sep. 12, 1997

[30] Foreign Application Priority Data

Sep. 13, 1996 [DE] Germany ..... 196 37 275

[51] Int. Cl.[6] ..... B02C 25/00

[52] U.S. Cl. ..... 241/30; 241/36

[58] Field of Search ..... 241/227, 36, 33, 241/27, 30

[56] References Cited

U.S. PATENT DOCUMENTS

| | | | |
|---|---|---|---|
| 1,130,365 | 3/1915 | Altheide | 74/721 |
| 3,412,769 | 11/1968 | Howard | 100/172 |
| 4,589,598 | 5/1986 | Ellery, Sr. | 162/254 |
| 4,627,577 | 12/1986 | Hyuga et al. | 241/34 |
| 4,798,343 | 1/1989 | Berndt | 241/189.2 |
| 5,088,651 | 2/1992 | Takahashi et al. | 241/30 |
| 5,395,057 | 3/1995 | Williams, Jr. et al. | 241/36 |

FOREIGN PATENT DOCUMENTS

| | | |
|---|---|---|
| 3834425 | 4/1990 | Germany . |
| 2140171 | 11/1984 | United Kingdom . |

*Primary Examiner*—Joseph J. Hail, III
*Assistant Examiner*—Susan R. Kingsbury
*Attorney, Agent, or Firm*—Hill & Simpson

[57] ABSTRACT

In two-roll machines for high-pressure disintegration of granular material, in which typically only one of the two rolls is motor driven, while the other roll is driven by means of friction via the granular material pressed in the roll gap, and thus operates as a drag roll, it is proposed to equip the drag roll with a separate, smaller drive mechanism including a separate smaller drive motor. This drive is thereby dimensioned in such a way that the startup of the drag roll is ensured and a drop in revolutions per minute of the drag roll is avoided. Alternatively, this separate drive is enlarged in such a way that it can transmit 10% to 40%, preferably 20%, of the total required drive power.

12 Claims, 1 Drawing Sheet

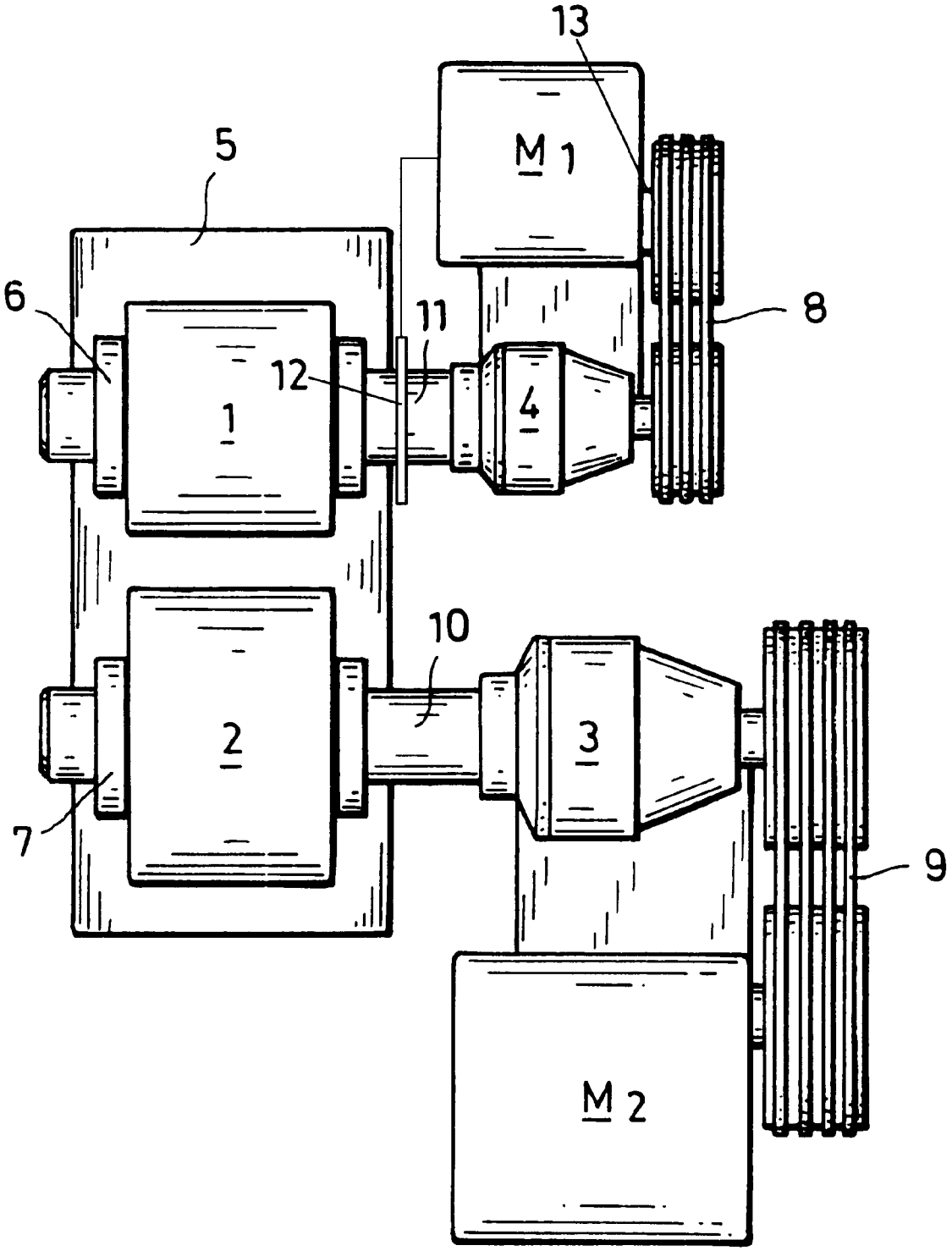
13
M 1
5
6
11
8
12
1
4
10
2
3
7
9
M 2

TWO-ROLL PRESS FOR PRESSURE TREATMENT OF GRANULAR MATERIAL

BACKGROUND OF THE INVENTION

The invention is directed to a two-roll machine, in particular a roll press, as well as to a method for operating the two-roll machine for the pressure treatment of granular goods, with two rolls that are rotatably mounted in a machine frame so as to be able to be rotated in directions opposed to one another, separated from one another by a roll gap, between which the granular material is drawn and is subjected to interparticle pressure treatment and is thereby disintegrated. One of the two rolls can be a fixed roll whose bearings are supported on the machine frame, and the other roll can be a loose roll, supported on the machine frame by a force acting from the outside.

High-pressure roll presses or, roll presses, are known for what is called the interparticle crushing of granular material, such as for example cement klinkers, which granular materials are pressed in the roll gap at high pressure to form plate-like agglomerates, which agglomerates are subsequently disagglomerated, whereby the material, pressed once, already comprises a high portion of the desired fineness.

In known high-pressure roll presses, one of the two rolls is fashioned as a fixed roll, supported against the machine frame via its bearings, while the other roll, as a loose roll, is supported via its bearings against an external force, for example against the hydraulic cylinder of a hydropneumatic system, with which the roll pressure force is applied and the adjustment of the width of the roll gap is carried out.

In known roll presses, normally both rolls are driven in opposite directions at the same RPM, by means of separate, equally large, drive motors with the necessary components of gearing, coupling, and torque bearings.

Due to the forcible coupling of the two rolls via the granular material located in the roll gap during the pressing, a differential loading of the individual drives cannot be excluded, particularly when the two rolls differ in diameter from one another.

In addition, the coupling of the two rolls via the pressed material, with simultaneous separate driving of the two rolls, results in increased wear on the roll surfaces because the driving of the rolls forces a slippage of the speed of the pressed material in relation to the speed of the circumference of the rolls.

In order to avoid these disadvantages, in DE-38 34 425 A1 it is proposed to provide only one of the two rolls with a rotational drive, while the other roll is frictionally driven as a drag roll via the material located in the roll gap. By means of this measure, in addition to a savings of energy, significant improvements are also achieved with respect to the wearing of the roll surfaces, since the speed of the circumference of the drag roll can adapt itself completely to the pressed material. A different diameter of the two rolls is also no longer significant in this case, since an approximately equal circumferential speed arises for both rolls due to the frictional force. However, in certain operational situations there may be difficulties in starting the dragged roll, whereby disturbances in the operation are caused, in particular during the final grinding in the circulation with further systems parts (ball mill, sifter).

SUMMARY OF THE INVENTION

The aim of the invention is to further develop the known two-roll machine from DE-38 34 425 A1 in such a way that the described disadvantages are avoided while the achieved advantages can be exploited.

This aim is solved with respect to the apparatus by means of providing each of the rolls with a drive motor, one drive motor being smaller in size with respect to its power relative to the other, such that the roll that the smaller motor drives will operate at least partially as a drag roller.

By means of the inventive measure of driving the rolls of the two-roll machine with rotational drive motors of different sizes, different operational states of the two-roll machine can be set, with full enjoyment of the advantages known from DE-38 34 425 A1. Thus, according to the invention it is for example possible for one of the rolls, advantageously the fixed roll, to stand in connection with a rotational drive motor, which applies 100% of the drive power required for the operation of the two-roll machine, so that during operation of the two-roll machine, when the roll gap is filled with granular material, the other roll, preferably the loose roll in this case, operates as a drag roll, driven by the fixed roll via the frictional force. According to the invention, this roll operating as a drag roll is connected with a rotational drive motor that is very much smaller in relation to the other roll, which smaller motor is intended only to ensure the starting of this drag roll, and otherwise is drivingly reactivated only in case of a drop in the revolutions per minute.

The advantages of the manner of operation of the two-roll machine with one roll fashioned as a drag roll are thus obtained, while at the same time the difficulties that can arise in pure drag roll operation without a separate drive are largely avoided by means of the "supporting" smaller rotational drive motor.

In order to run up again to the operating revolutions per minute in case of a drop in revolutions per minute of the drag roll, according to the invention, the rotational drive motor is a RPM-controlled motor, or else a coupling is arranged between the rotational drive motor and the roll drive assembly, which coupling engages only in case of a drop in revolutions per minute. In order to ensure that the revolutions per minute of the drag roll are raised in the short term back up to the required operational revolutions per minute in case of a drop in revolutions per minute, at least the drag roll is connected with a means for monitoring revolutions per minute, with which the necessary intervention for the increase of the revolutions per minute can be activated.

An alternative according to the invention is to couple one of the two rolls, preferably here as well the fixed roll, with a rotational drive motor, which applies 60% to 90%, preferably 80%, of the total drive power required for the operation of the two-roll machine, and to equip the other roll, which now no longer operates exclusively as a drag roll, with a rotational drive motor, which applies the rest of the required drive power, namely 10% to 40%, preferably 20%, of the overall required drive power.

By means of torque monitoring, the rotational drive motor of the drag roll is controlled in such a way that it holds a constant predetermined torque, which corresponds to the desired drive power of 10% to 40%, preferably 20%, of the overall drive power to be expended in the operation of the two-roll machine. Although in this alternative there is no pure dragged operation of a roll, and the advantages of pure drag operation are thereby somewhat reduced, this is outweighed here by the advantages of operational security, since in case of disturbances in operation the rotational drive motor of this roll does not have to be started with a time delay, since it remains activated at all times during the entire duration of operation.

Because the drive mechanism for the pure drag roll or, respectively, for the roll operating partially as a drag roll, is considerably smaller in relation to the main drive of the other roll, the space requirement for this drive, consisting of the rotational drive motor, gearing, coupling, and torque bearing, is also considerably reduced, so that in rolls with a relatively small diameter, both drive mechanisms can be arranged next to one another on one side of the two-roll machine, thus also improving accessibility for necessary maintenance work.

Since, in addition, the roll diameter of the two rolls need no longer necessarily comprise the same diameter (the same circumferential speed is ensured for both rolls by means of frictional force via the granular material in the roll gap), it is possible to exchange the rolls individually as needed, whereby the idle time of the two-roll machine caused thereby is considerably reduced.

BRIEF DESCRIPTION OF THE DRAWINGS

In a FIGURE in the drawing, an exemplary embodiment of the invention is presented in a schematic top view of a two-roll machine.

DETAILED DESCRIPTION OF THE PREFERRED EMBODIMENTS

In a machine frame 5, the two rolls 1, 2 are rotatably mounted via their bearings 6, 7. One of the two rolls, the roll 2 in the exemplary embodiment, is driven via its shaft 10 by a rotational drive motor $M_2$, for which purpose the rotational drive motor $M_2$ is connected with the shaft 10 via a V-belt 9 and gearing 3.

A smaller drive mechanism for the other roll 1, which in this exemplary embodiment comprises the same diameter as the roll 2, but which could be of a different diameter, is also located on the same side of the machine frame. This drive, which is applied to a shaft 11 of the roll 1 and consists of a rotational drive motor $M_1$, V-belt 8 and gearing 4, is considerably smaller in relation to the drive for the roll 2 according to the invention, since according to the invention only essentially smaller amounts of drive power are to be transmitted with this drive. The rotational drive motor $M_1$ is connected with a means for monitoring revolutions per minute (12) for the roll 1, if, apart from startup, this drive is to be activated only in case of a drop in revolutions per minute. The means for monitoring the revolutions per minute could comprise an RPM controlled motor as the smaller motor $M_1$ or could comprise a coupling 13 between the motor $M_1$ and the shaft 11 of the roll 1 which engages only in case of a drop in revolutions per minute below a predetermined speed.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

I claim as my invention:

1. A roll press for operating to provide interparticle crushing of granular material, with two rolls rotatably mounted in a machine frame so as to rotate in opposite directions to one another and being separated from one another by a roll gap, between which said granular material is drawn and is subjected to interparticle crushing and is thereby disintegrated, comprising two separate rotational drive motors, one comparatively large and one comparatively small in power, said large power motor drivingly connected to a first of said rolls and said small power motor drivingly connected to a second of said rolls, wherein said second roll operates at least partially as a drag roll, said small power motor is connected with a means for monitoring revolutions per minute of said second roll, and means associated with said small power motor and said second roll to provide a driving engagement between said small power motor and said second roll upon detection of a drop in the revolutions per minute of said second roll by said monitoring means.

2. A roll press according to claim 1, wherein said large power motor transmits approximately 100% of an energy requirement needed for said operation of said roll press, and said small motor's size is such to transmit only an energy required to start up said second roll and to maintain predetermined operational revolutions per minute of said second roll, and said second roll otherwise operates as a drag roll when its smaller motor is deactivated.

3. A roll press according to claim 2, wherein said first roll is a fixed roll.

4. A roll press according to claim 1, wherein said large power motor transmits approximately 60%–90% of an energy requirement needed for said operation of said roll press, and said small power motor transmits a remaining approximately 40%–10% of said energy requirement needed for operation of said roll press, such that said second roll operates partially as a drag roll.

5. A roll press according to claim 1, wherein said two rolls have diameters of different sizes.

6. A roll press according to claim 1, wherein said means associated with said small power motor and said second roll comprises said small power motor being an RPM-controlled motor, controlled by said means for monitoring revolutions per minute of said second roll.

7. A roll press according to claim 1, wherein said means associated with said small power motor and said second roll comprises a coupling between said small power motor and said second roll which engages only in case of a drop in revolutions per minute of said second roll.

8. A method for operating a roll press to provide interparticle crushing of granular material, with two rolls rotatably mounted in a machine frame so as to rotate in opposite directions to one another and being separated from one another by a roll gap, between which said granular material is drawn and is subjected to interparticle crushing and is thereby disintegrated, utilizing two separate rotational drive motors, one comparatively large and one comparatively small in power, each one drivingly connected to a respective one of said rolls, wherein one of said two rolls operates at least partially as a drag roll, comprising the steps:

initially activating both drive motors during a startup process of said roll press, deactivating said small drive motor upon said rolls achieving a predetermined operational speed in terms of revolutions per minute, driving said roll normally driven by said small drive motor by said other roll, as a drag roll, via friction transmitted by said granular material located in said roll gap, reactivating said small drive motor in the event that there is a drop in said operational revolutions per minute of said drag roll.

9. A method according to claim 8, wherein said step of reactivating said small drive motor is undertaken by providing said small drive motor as an RPM-controlled motor.

10. A method according to claim 8, wherein said step of reactivating said small drive motor is undertaken by providing a coupling between said small motor and its driven roll which engages only in case of a drop in revolutions per minute.

11. A method for operating a roll press to provide interparticle crushing of granular material, with two rolls rotatably mounted in a machine frame so as to rotate in opposite directions to one another and being separated from one another by a roll gap, between which said granular material is drawn and is subjected to interparticle crushing and is thereby disintegrated, utilizing two separate rotational drive motors, one comparatively large and one comparatively small in power, each one drivingly connected to a respective one of said rolls, wherein one of said two rolls operates at least partially as a drag roll, comprising the steps:

activating both drive motors during a startup process of said roll press, controlling said small drive motor such that it holds approximately constant a predetermined torque corresponding to a drive power of approximately 10% to 40% of a total drive power required for said roll press, such that the roll the smaller drive motor drives is driven only partially as a drag roll by the other roll.

12. A method according to claim 11, wherein said small drive motor is controlled to provide a torque corresponding to a drive power of approximately 20% of the total drive power required for said roll press.

* * * * *